US006672997B1

(12) United States Patent
Winkler

(10) Patent No.: US 6,672,997 B1
(45) Date of Patent: Jan. 6, 2004

(54) ADJUSTABLE EXERCISE THERAPY DEVICE

(76) Inventor: Charles Allen Winkler, 7722 Reseda Blvd., Apt. 30, Los Angeles, CA (US) 91335

( * ) Notice: Subject to any disclaimer, the term of this patent is extended or adjusted under 35 U.S.C. 154(b) by 159 days.

(21) Appl. No.: 09/920,557

(22) Filed: Aug. 2, 2001

(51) Int. Cl.[7] ..... A63B 21/00
(52) U.S. Cl. ..... 482/126; 482/121; 482/82
(58) Field of Search ..... 482/81, 82, 126, 482/124, 121, 122, 49, 129, 130, 91

(56) References Cited

U.S. PATENT DOCUMENTS 1,566,235 A * 6/1925 Sheehan ..... 482/121
4,019,734 A * 4/1977 Lee et al. ..... 482/126
5,314,396 A * 5/1994 Parr ..... 482/121
5,514,059 A * 5/1996 Romney ..... 480/124
6,517,470 B1 * 2/2003 Chak et al. ..... 480/126

* cited by examiner

*Primary Examiner*—Jerome W. Donnelly
(74) *Attorney, Agent, or Firm*—Allan M. Shapiro

(57) ABSTRACT

The adjustable exercise therapy device of this invention has first and second handles suitable for manual grasp and a single bungee cord passing through both handles. The bungee cord is adjustably attached to one of the handles. Between the handles, a tube holds the two stands of the bungee cord together. The distance between the handles can be adjusted so that the device is suitable for use as an exercise device for people of limited strength.

19 Claims, 1 Drawing Sheet

ADJUSTABLE EXERCISE THERAPY DEVICE

FIELD OF THE INVENTION

This invention is directed to an adjustable exercise therapy device which has first and second handgrips connected by a resilient bungee cord. There is adjustability for length between the handgrips to adjust for the user's size and the stiffness of the pull between the handgrips so as to be particularly useful for disabled persons who get little arm and/or leg exercise.

BACKGROUND OF THE INVENTION

There are many persons of limited physical capability who have the need for physical exercise. In some cases, doctors prescribe exercise. In other cases, persons realize they need some exercise and try to do what they can. However, the exercise devices used by persons of full physical capability are usually too strong for those of limited strength. Furthermore, adjustability is required so that the person of limited strength can operate with the exercise therapy device in the optimum position so that no excess stress and strain are created. Thus, there is need for an adjustable exercise therapy device suitable for persons of limited physical capability.

SUMMARY OF THE INVENTION

In order to aid in the understanding of this invention, it can be stated in essentially summary form that it is directed to an adjustable exercise therapy device which comprises a bungee cord with a pair of handles attached thereto. At least one of the handles is adjustable along the length of the bungee cord so that the length between the handles can be chosen in accordance with the type of exercise and the size and condition of the person desiring the exercise. In one type of exercise, the cords are passed through a flexible tube which is positioned against the back of the user.

It is, thus, a purpose and advantage of this invention to provide an adjustable exercise therapy device which has a pair of handles and which is provided with adjustment so that the distance between the handles can be adjusted so that it is useful for different exercises and different persons utilizing the therapy device.

It is another purpose and advantage of this invention to provide an economical adjustable exercise therapy device which is convenient and comfortable to use and which can be adjusted so that it is suitable for different exercises and different persons so that it is widely available to those in need of such an exercise therapy device.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
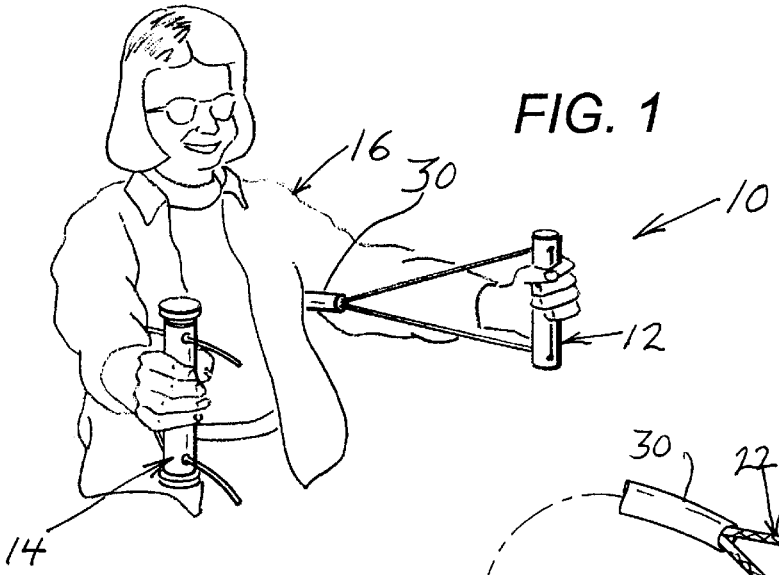
FIG. 1 is a perspective view of the adjustable exercise therapy device of this invention, as used with an arm exercise.
Figure 2:
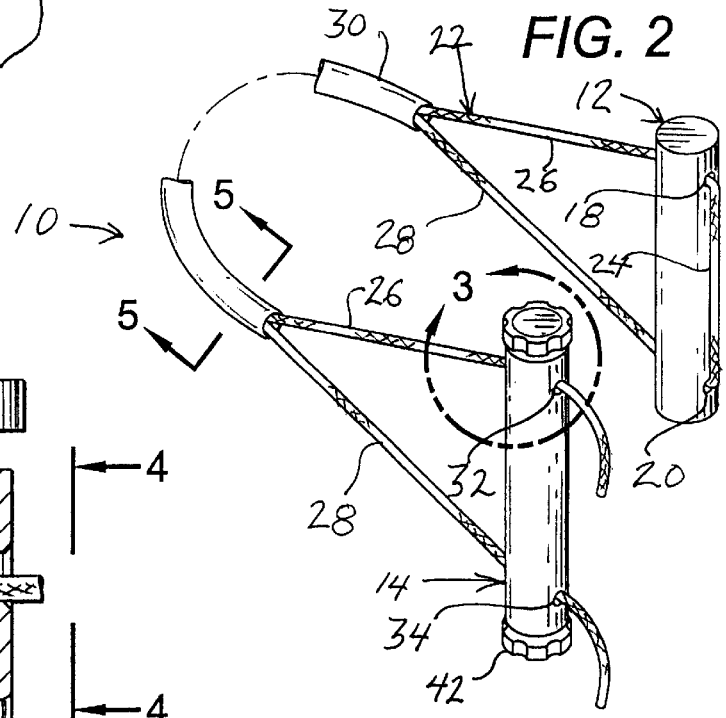
FIG. 2 is an enlarged perspective view thereof, with parts broken away.

The adjustable exercise therapy device of this invention is generally indicated at 10 in FIGS. 1 and 2. The device 10 has first and second handles 12 and 14. The handles have cylindrical or close to cylindrical exterior surfaces. They may be tubular or may be solid, as shown. The diameter is such as to be comfortable when fully grasped in the hand by the person 16 who is exercising, as shown in FIG. 1. A diameter of 1 inch to 1½ inches is suitable. The material of the handles is substantially rigid and may be metal, but a synthetic polymer composition material such as acrylic is preferred, both because of appearance and because it does not feel so cold in the hands. The length of each handle is such as to extend out of the hand of the exerciser a sufficient distance so that the ends are free, as shown in FIG. 1.

Figure 5:
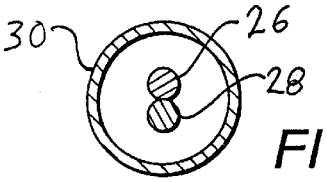
FIG. 5 is an enlarged section taken generally along line 5—5 of FIG. 2.

As seen in FIG. 2, the first handle 12 has first and second holes 18 and 20 therethrough adjacent its ends. One-piece bungee cord 22 has a loop 24 on the front of the handle 12, while its stands 26 and 28 extend through the holes 18 and 20 in the handle 12. The stands 26 and 28 of the bungee cord 22 pass through back tube 30. Back tube 30 is flexible polymer composition material and is considerably larger than the two stands of the bungee cord, as seen in FIG. 5. The purpose of this size is to permit the back tube to spread the load of the force on the person's back when the exerciser uses the device 10, as shown in FIG. 1. Thus, the tube 30 is flexible, but not limp. It would be undesirable for the back tube 30 to have creases or folds therein which would localize force on the back of the exerciser 16.

Figure 3:
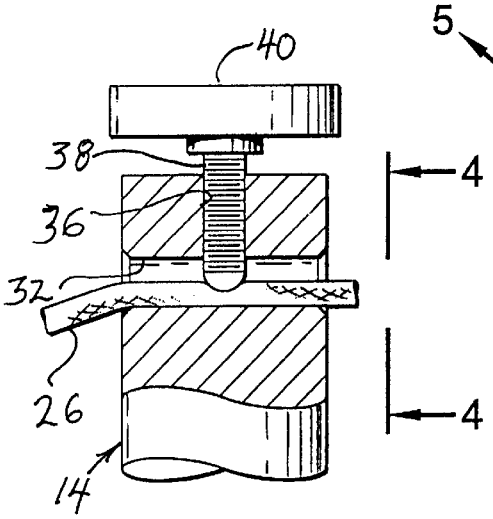
FIG. 3 is an enlarged side elevational view of the top end of one of the handles, taken at line 3 in FIG. 2, with parts broken away and parts taken in section.
Figure 4:
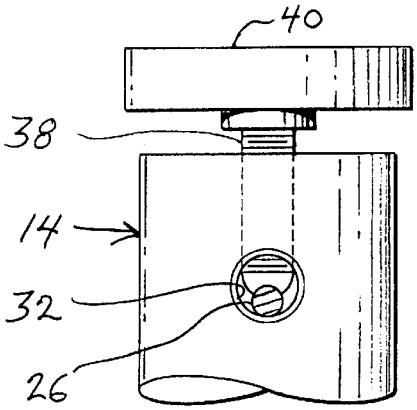
FIG. 4 is a side elevational view, as seen generally along line 4—4 of FIG. 3, with parts broken away.

The second handle 14 has first and second holes 32 and 34 therethrough, which holes are substantially larger than the standard bungee cord 22, as seen in FIGS. 3 and 4. The stands 26 and 28, respectively, pass through these holes 32 and 34. The second handle 14 has threaded holes in the top and bottom, respectively, into the holes 32 and 34. The threaded hole 36 is shown in FIG. 3. Clamp screw 38 has a rounded nose and is threaded to engage in the hole 36. Clamp screw 38 carries knob 40 thereon. The knob 40 is at least as large as the diameter of handle 14 for ease of grasp and tightening. As seen in FIGS. 3 and 4, the stand 26 engages through hole 32, and the rounded nose of the clamp screw clamps onto the bungee cord to secure it in place by pressing it against the interior wall of the handle hole 32. A similar clamp screw and knob 42 are provided adjacent the second hole 34.

The exerciser adjusts the length between the handles 12 and 14 when the bungee cord is not stretched. Adjustment is accomplished by laying out the device 10, loosening the clamp screws 38 and 42, and moving the free ends through the handle 14 to the desired position. Thereupon, the clamp screws are tightened.

When adjusted, the adjustable exercise therapy device 10 can be used. One of the exercises is as shown in FIG. 1 where the back tube rests against the exerciser's back below her shoulders. The elbows are bent when the bungee cord is slack. Exercise is accomplished by thrusting both handles forward at the same time. This exercises her shoulder and arm muscles. The heel of the hand presses against the handles, and there is no wrist action, so as to avoid carpal tunnel stress. If greater force is desired, the effective length of the bungee cord can be shortened. In this exercise, the arms are not swung wide and brought forward but, in all cases, the elbows are held close to the body.

In another exercise, the foot can be placed in one of the handles, and the other handle held in one or both hands. The leg can be exercised by bending at the hip and knee while the resistance and consequent muscular exercise is provided by the one or two hands holding the upright of the device 10. In that way, one leg can be exercised at a time, while one or both arms are exercised by providing the resistance at the upper end of the device.

Other exercises are also possible with the device 10. The holes 18 and 20 in handle 12 and holes 32 and 34 in handle 14 are much larger than the size of the standard bungee cord. Similarly, the back tube 30 has an interior diameter much larger than is required for the two stands of the bungee cord. This is because the device is configured so that, when the exerciser feels the need for more strenuous exercise, a heavier than standard bungee cord can be installed therein. This provides further variation in the capability of the device 10.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An adjustable exercise therapy device comprising:

first and second handles, each of said first and second handles being sized to be grasped in the hand and being sized to extend beyond the hand at an upper end and a lower end, each of said first and second handles having first and second holes therethrough, said first hole being adjacent said upper end and positioned to be above the hand of a person grasping said handle and said second hole being adjacent said lower end and positioned to be below the hand of a person grasping said handle, said holes being sized to receive a bungee cord therethrough;

a bungee cord, said bungee cord extending through all of said holes, a releasable clamp screw extending into said second handle at at least one of said holes on said second handle, said releasable clamp screw being configured to releaseably clamp said bungee cord at said hole so that the length of bungee cord between said first and second handles can be adjusted.

2. The adjustable exercise therapy device of claim 1 further including a back tube surrounding said bungee cord between said handles, said bungee cord and said back tube being sufficiently long to extend around the back of the exerciser when the exerciser grasps said first and second handles.

3. The adjustable exercise therapy device of claim 2 wherein said back tube has a tubular hole therethrough which is sufficiently large so that said back tube is free to slide along said bungee cord for adjustable location against the back of the user.

4. The adjustable exercise therapy device of claim 3 wherein said back tube is made of resilient synthetic polymer composition tubing.

5. The adjustable exercise therapy device of claim 1 wherein there are first and second clamp screws on said second handle respectively associated with said first and second holes through said second handle so that said bungee cord is adjustable with respect to said second handle at both said first and second holes therethrough and clampable thereat.

6. The adjustable exercise therapy device of claim 1 wherein said clamp screw comprises a screw threadedly engaged in said handle and entering into said hole so that said screw clamps upon said bungee cord and further comprising a knob on said screw for tightening said screw into a position where it clamps said bungee cord.

7. The adjustable exercise therapy device of claim 6 wherein said knob is at least as large as said handle to aid in grasping thereof.

8. The adjustable exercise therapy device of claim 7 further including a back tube surrounding said bungee cord between said handles, said bungee cord and said back tube being sufficiently long to extend around the back of the exerciser when the exerciser grasps said first and second handles.

9. The adjustable exercise therapy device of claim 8 wherein said back tube has a tubular hole therethrough which is sufficiently large so that said back tube is free to slide along said bungee cord.

10. The adjustable exercise therapy device of claim 9 wherein said back tube is made of resilient synthetic polymer composition tubing.

11. An adjustable exercise therapy device comprising:

first and second handles, each of said first and second handles being sized to be grasped in the hands of a user of said exercise device, each of said handles having a top end and a lower end, said handles each being sized so that said top end and said bottom end of each of said handles extend out beyond the hands of the user;

a back tube for positioning behind the back of a user;

a single bungee cord, said single bungee cord extending through said holes adjacent said upper and lower ends of said first handle so that there are two stands of bungee cord extending from said first handle, said two stands of said bungee cord extending through said back tube and extending through said holes adjacent the upper and lower ends of said second handle; and clamp screw structure extending into said second handle for releasably clamping said stands of said bungee cord adjacent said second handle so that the length of said device can be adjusted.

12. The adjustable exercise therapy device of claim 11 wherein both said first and second handles are made of synthetic polymer composition material.

13. The adjustable exercise therapy device of claim 11 wherein said back tube is made out of synthetic flexible polymer composition material.

14. The adjustable exercise therapy device of claim 11 wherein said clamp screw structure separately clamps said two stands of said bungee cord at said second handle.

15. The adjustable exercise therapy device of claim 11 wherein there is a hole in said second handle intersecting with said bungee cord hole adjacent said upper end of said handle and there is a hole in said second end of said handle intersecting said second bungee cord hole and there are first and second clamp screws positioned in said holes for releasably clamping said bungee cord with respect to said hole.

16. The adjustable exercise therapy device of claim 15 wherein there is a knob on each of said clamp screws, said knob being for tightening said clamp screw against said bungee cord.

17. The adjustable exercise therapy device of claim 16 wherein said knob is larger than said handle to aid in clamping of said bungee cord by persons using said device who are of limited physical capability.

18. The adjustable exercise therapy device of claim 17 wherein both said first and second handles are made of synthetic polymer composition material.

19. The adjustable exercise therapy device of claim 17 wherein said back tube is made out of synthetic flexible polymer composition material.

* * * * *